US006537060B2

(12) United States Patent
Vegter

(10) Patent No.: US 6,537,060 B2
(45) Date of Patent: Mar. 25, 2003

(54) REGULATING SYSTEM FOR GAS BURNERS

(75) Inventor: Derk Vegter, Amsterdam (NL)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/190,199

(22) Filed: Jul. 3, 2002

(65) Prior Publication Data

US 2003/0013057 A1 Jan. 16, 2003

Related U.S. Application Data

(63) Continuation of application No. 09/701,687, filed on Mar. 9, 2001, now abandoned.

(51) Int. Cl.[7] ..... F23N 1/02
(52) U.S. Cl. ..... 431/90; 431/12; 431/89
(58) Field of Search ..... 431/12, 89, 90, 431/20, 29, 30, 31

(56) References Cited

U.S. PATENT DOCUMENTS

| | | | | |
|---|---|---|---|---|
| 3,300,133 | A | 1/1967 | Dines | 236/14 |
| 5,088,916 | A | 2/1992 | Furuhashi et al. | 431/90 |
| 5,520,533 | A | 5/1996 | Vrolijk | 431/90 |

FOREIGN PATENT DOCUMENTS

| | | |
|---|---|---|
| AT | 190195 | 7/1956 |
| DE | 2427819 | 4/1980 |
| DE | 3707883 | 7/1988 |
| GB | 1571906 A | 7/1980 |
| JP | 59097421 A | 9/1984 |
| JP | 60-29516 | 2/1985 |
| JP | 60080018 A | 9/1985 |
| JP | 60122818 A | 11/1985 |
| JP | 60164115 A | 12/1985 |
| JP | 63-271022 | 11/1988 |

*Primary Examiner*—Carl D. Price
(74) *Attorney, Agent, or Firm*—Kris T. Fredrick

(57) ABSTRACT

A burner system for controlling the gas/air mixture of a burner has a sensor providing a signal dependent on the pressures in gas and air lines supplying the burner. A summing device receives a signal based on the air flow rate and the signal from the sensor, and provides a regulating signal controlling the setting of a gas regulating valve regulating the flow of gas in the gas line.

4 Claims, 1 Drawing Sheet

REGULATING SYSTEM FOR GAS BURNERS

CROSS REFERENCE TO RELATED APPLICATION

This patent application is a continuing application of U.S. patent application Ser. No. 09/701,687 filed on Mar. 9, 2001 now ABN by Derk Vegter.

BACKGROUND OF THE INVENTION

The invention relates to a regulating system for controlling the gas/air mixture of gas burners.

Regulating systems for gas burners serve to provide a gas/air mixture, that is, they serve to feed a gas flow and a combustion-air flow to a burner. In this case, the gas flow through a gas valve can be set as a function of the combustion-air pressure. Such regulating systems have been disclosed by DE 24 27 819 B2, Austrian Patent 190 195 and De 37 07 883 C1.

Regulating systems for gas burners are known in which the transmission ratio between gas pressure and combustion-air pressure or between gas flow and combustion air flow is variable. In all the known regulating systems, the requisite pressure measurement is carried out by means of a diaphragm, that is pneumatically. However, this pneumatic method has a large number of disadvantages, which all together restrict the range of application of known regulating systems. Thus the hysteresis properties of the diaphragm and the forces acting between the diaphragm and the gas valve restrict the working range and thus the range of application. Furthermore, the interplay between the requisite small actuating forces and the operating tolerances of the diaphragm, as a result of disturbances such as temperature fluctuations or the like, restricts the range of application of known regulating systems.

Against this background, the problem underlying the present invention is to provide a regulating system for gas burners which avoids the abovementioned disadvantages and thus has a greater range of application.

BRIEF DESCRIPTION OF THE INVENTION

This problem is solved by a regulating system for gas burners that controls gas flow based on the air flow and the pressures in the gas flow and air flow ducts.

Further advantageous refinements of the invention follow. A preferred exemplary embodiment of the invention is explained in more detail below with reference to the drawing.

DESCRIPTION OF THE PREFERRED EMBODIMENT

Figure 1:
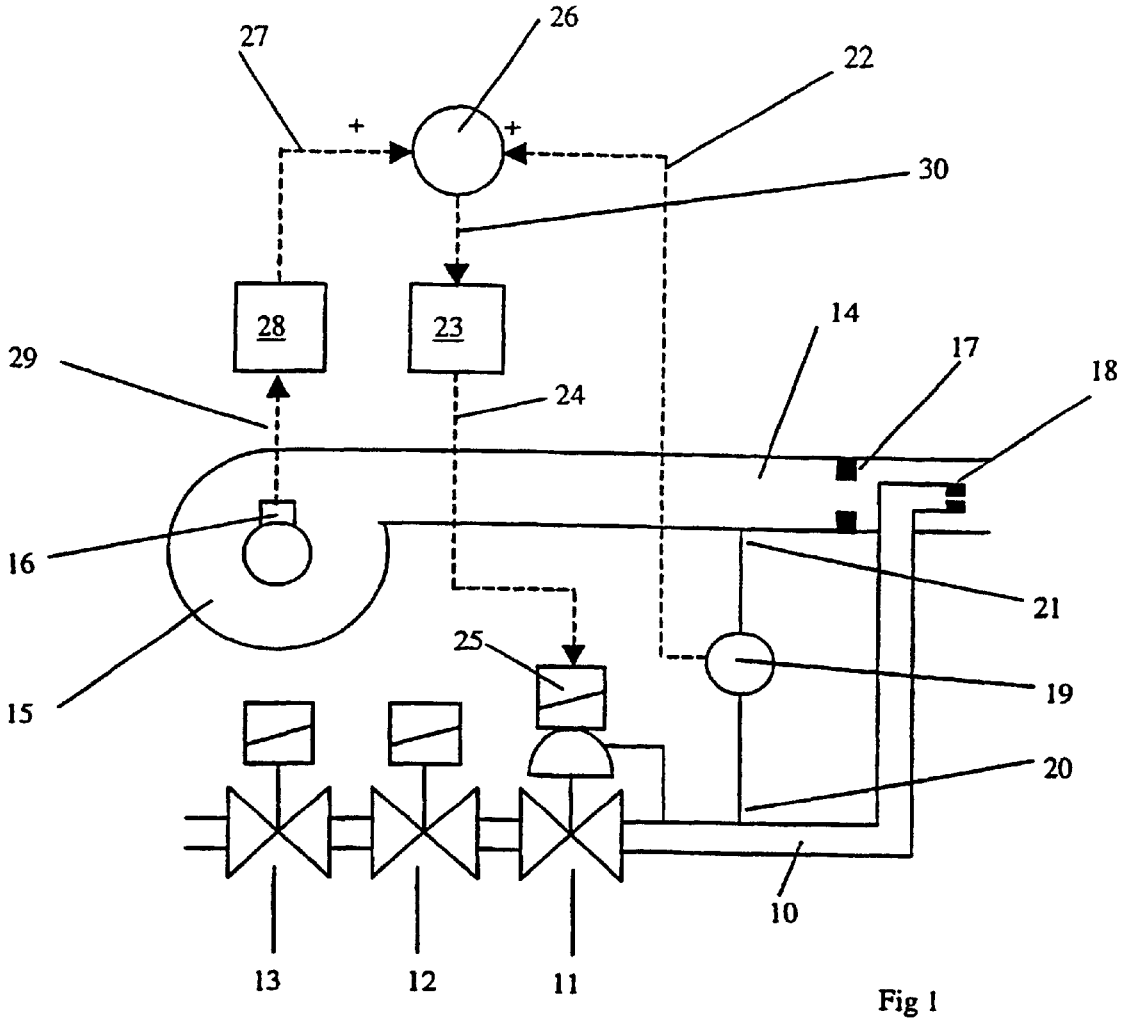
FIG. 1 shows a regulating system according to the invention with further modules in schematic representation.

The regulating system shown in the drawing serves to provide a gas/air mixture for a gas burner (not shown).

With reference to FIG. 1 a gas flow can be fed to the burner (not shown) via a first line 10. A gas-regulating valve 11 and two gas safety valves 12, 13 are assigned to the first line 10 carrying the gas flow. The gas-regulating valve 11 and the gas safety valves 12, 13 may be of any desired design. The construction and mode of operation of gas safety valves and gas-regulating valves are sufficiently known from the prior art.

Furthermore, a combustion-air flow can be fed to the burner (not shown) via a second line 14. The combustion-air flow is produced by a fan 15, the rotational speed of which is determined by a motor 16 assigned to the fan 15.

A restrictor or choke point 17 is arranged inside the second line 14 carrying the combustion-air flow. In the region downstream of the choke point 17, the first line 10 carrying the gas flow opens into the second line 14 carrying the air flow. In this region, the first line 10 carrying the gas flow is terminated by gas nozzle 18.

A sensor 19 is arranged between the first line 10 carrying the gas flow and the second line 14 carrying the combustion-air flow. The sensor 19 is connected by a first measuring point 20 to the first line 10 carrying the gas flow, namely upstream of the gas nozzle 18 in the direction of flow of the gas. Furthermore, the sensor 19 is connected by a second measuring point 21 to the second line 14 carrying the combustion-air flow, namely upstream of the choke point 17 in the direction of flow of the combustion air.

The sensor 19 is designed as a differential-pressure sensor, in particular as a flow-rate meter or anemometer. The pressure difference between the gas pressure and the combustion-air pressure can therefore be determined by means of the sensor 19.

If the gas pressure matches the combustion air, the flow through the sensor 19 designed as flow-rate meter or anemometer is equal to zero. If the combustion-air pressure is higher than the gas pressure, a flow from the second measuring point 21 in the direction of the first measuring point 20 can be detected. On the other hand, if the combustion-air pressure is lower than the gas pressure, a flow from the first measuring point 20 in the direction of the second measuring point 21 can be detected by the sensor 19. The pressure ratios of gas pressure and combustion-air pressure can therefore be determined by the sensor 19 from the rate of flow through the sensor 19 and from the direction of flow.

Depending on these pressure ratios, the sensor 19 generates an electrical or electronic signal 22. This electrical or electronic signal 22 is fed to a control unit or regulating unit 23, which generates a regulating signal 24 for an actuator 25 of the gas-regulating valve 11.

To insure a variable transmission ratio between gas pressure and combustion-air pressure or gas flow and combustion-air flow, the electrical or electronic signal 22 of the sensor 19 is balanced with an auxiliary signal 27 in a summing device 26, specifically before the signal 22 is fed to the regulating unit 23. The output signal 30 of the summing device 26 is therefore fed as input signal to the regulating unit 23, the output signal 30 being an additive superimposition of the signals 22, 27.

The auxiliary signal 27 is a signal which functionally depends on a rotational speed of the fan 15. The auxiliary signal 27 is obtained in an evaluating device 28 from a rotational-speed signal 29 of the fan 15 or of the motor 16 of the fan 15. Since the auxiliary signal 27 functionally depends on the rotational speed of the fan 15, it directly follows that the auxiliary signal 27 depends on the combustion-air flow or combustion-air pressure.

Unlike the exemplary embodiment shown, it is possible to generate the auxiliary signal 27 in another way. Thus it is not absolutely necessary for the auxiliary signal 27 to be determined from the rotational speed of the fan. It is also conceivable to provide an additional sensor (not shown) for determining the combustion-air flow and thus for generating the auxiliary signal 27.

To provide a gas/air mixture with a variable transmission ratio between gas pressure and combustion-air pressure, the procedure with the regulating system according to the invention is therefore as follows:

An electrical or electronic signal 22 which corresponds to the pressure difference between the gas pressure and the combustion-air pressure is determined by means of the sensor 19. This electrical or electronic signal 22 is balanced with an auxiliary signal 27. To this end, the electrical or electronic signal 22 and the auxiliary signal 27 are added. The auxiliary signal 27 depends on the combustion-air flow, in particular on the rotational speed of the fan 15. The output signal 30, determined from the signals 22, 27, of the summing device 26 is fed to a regulating unit 23, which generates a regulating signal 24 for the actuator 25 of the gas-regulating valve 11. In this case, the regulating signal 24 is determined in such a way that the regulating unit 23 changes the gas flow to the effect that the input signal for the regulating unit 23, that is the signal 30 determined from the signals 22, 27, assumes a value of zero.

A factor which determines the transmission ratio between gas flow and combustion-air flow can be determined in the evaluating device 28. This factor is a multiplication factor. The higher this multiplication factor is, the higher is the transmission ratio. The transmission ratio can be varied by varying the multiplication factor.

List of Designations

10 Line
11 Gas-regulating valve
12 Gas safety valve
13 Gas safety valve
14 Line
15 Fan
16 Motor
17 Choke point
18 Gas nozzle
19 Sensor
20 Measuring point
21 Measuring point
22 Signal
23 Regulating unit
24 Regulating signal
25 Actuator
26 Summing device
27 Auxiliary signal
28 Evaluating device
29 Rotational-speed signal
30 Out put signal The preceding has described my invention.

What I wish to claim is:

1. A burner system for providing a gas flow and a combustion-air flow to a burner, including:

a) a first line (10) carrying the gas flow;

b) a gas regulating valve (11) in the first line (10) receiving a regulating signal (24) and varying the gas flow rate in the first line responsive to the regulating signal (24);

c) a second line (14) carrying the combustion air flow;

d) an evaluating device (28) operatively connected to sense the combustion air flow and to provide an auxiliary signal (27) depending on the combustion air flow;

e) a sensor (19) connected between the first line (10) carrying the gas flow and a second line (14) carrying the combustion-air flow, and providing a signal (22) dependent on the gas pressure and the combustion air pressure;

f) a summing device (26) receiving the signal (22) of the sensor (19) and the auxiliary signal (27) and providing a sum signal (30) depending on the sensor signal (22) and the auxiliary signal; and g) a regulating unit (23) receiving the sum signal (30) and generating the regulating signal (24) for the gas regulating valve (11).

2. The burner system of claim 1, including a fan (15) providing the combustion air flow and whose rotational speed determines the flow rate of combustion air; and wherein the evaluating device (28) provides an auxiliary signal (27) depending on the rotational speed of the fan (15).

3. The burner system of claim 2, including a gas nozzle (18) in the first line (10), a flow restrictor (17) in the second line (14), a first measuring point (20) in the first line (10) upstream of the gas nozzle (18), and a second measuring point (21) in the second line (14) upstream of the flow restrictor (17), and wherein the sensor (19) is connected to the first line (10) at the first measuring point (20) and the sensor (19) is connected to the second line (14) at the second measuring point (21).

4. The burner system of claim 1, including a gas nozzle (18) in the first line (10), a flow restrictor (17) in the second line (14), a first measuring point (20) in the first line (10) upstream of the gas nozzle (18), and a second measuring point (21) in the second line (14) upstream of the flow restrictor (17), and wherein the sensor (19) is connected to the first line (10) at the first measuring point (20) and the sensor (19) is connected to the second line (14) at the second measuring point (21).

* * * * *